US005982089A

United States Patent [19]

Wesselink et al.

[11] Patent Number: 5,982,089

[45] Date of Patent: Nov. 9, 1999

[54] LOW-PRESSURE MERCURY DISCHARGE MEANDER LAMP DIMENSIONED FOR EVEN ILLUMINATION AND FAVORABLE POWER CONSUMPTION

[75] Inventors: Gustaaf A. Wesselink, Knegsel; Franciscus A. S. Ligthart, Waalre, both of Netherlands

[73] Assignee: U.S. Philips Corporation, New York, N.Y.

[21] Appl. No.: 08/150,099

[22] PCT Filed: Mar. 26, 1993

[86] PCT No.: PCT/NL93/00073

§ 371 Date: Nov. 19, 1993

§ 102(e) Date: Nov. 19, 1993

[87] PCT Pub. No.: WO93/20579

PCT Pub. Date: Oct. 14, 1993

[30] Foreign Application Priority Data

Mar. 27, 1992 [EP] European Pat. Off. ..... 92200875

[51] Int. Cl.[6] ..... H01J 1/62

[52] U.S. Cl. ..... 313/493

[58] Field of Search ..... 313/493, 491, 313/634, 484, 485, 487, 486; 315/169.3, 169.4, 248; 428/426; 427/510

[56] References Cited

U.S. PATENT DOCUMENTS

| | | | |
|---|---|---|---|
| 2,433,218 | 12/1947 | Herzog | 176/122 |
| 3,937,998 | 2/1976 | Verstegen et al. | 313/487 |
| 4,559,470 | 12/1985 | Murakami et al. | 313/487 |
| 4,743,799 | 5/1988 | Loy | 313/493 |
| 4,798,768 | 1/1989 | Oversluizen et al. | 428/426 |
| 4,842,378 | 6/1989 | Flasck et al. | 350/345 |
| 4,920,298 | 4/1990 | Hinotani et al. | 313/493 |
| 5,004,948 | 4/1991 | Kinczel et al. | 313/486 |
| 5,041,762 | 8/1991 | Hartai | 313/493 |
| 5,043,627 | 8/1991 | Fox | 313/491 |
| 5,220,249 | 6/1993 | Tsukada | 313/493 |
| 5,239,238 | 8/1993 | Bergervoet et al. | 315/248 |
| 5,281,448 | 1/1994 | Altena et al. | 427/510 |

FOREIGN PATENT DOCUMENTS

| | | | |
|---|---|---|---|
| 1231904 | 10/1960 | France . | |
| 2230653 | 9/1990 | Japan | H01J 61/067 |
| 1514281 | 6/1978 | United Kingdom | H01J 61/72 |

OTHER PUBLICATIONS

Brochure—Harison Electric Co., Ltd., pp. 1–6, No Date.

*Primary Examiner*—Sandra O'Shea
*Attorney, Agent, or Firm*—F. Brice Faller

[57] ABSTRACT

A meander-shaped low-pressure mercury discharge lamp with cold electrodes (7, 8), in particular for use in an illumination panel for a liquid crystal display. The geometry of the tubular lamp vessel (1) bent into a meander shape is so chosen, for obtaining a good homogeneity of the luminance and a high luminous efficacy, that the length of the discharge path is between 250 and 1000 times the internal diameter of the lamp vessel (1). The internal diameter of the lamp vessel (1) preferably has a value of between 2.0 and 3.5 mm.

10 Claims, 2 Drawing Sheets

LOW-PRESSURE MERCURY DISCHARGE MEANDER LAMP DIMENSIONED FOR EVEN ILLUMINATION AND FAVORABLE POWER CONSUMPTION

BACKGROUND OF THE INVENTION

The invention relates to a low-pressure mercury discharge lamp which comprises an elongate tubular lamp vessel which is sealed in a vacuumtight manner, which extends in a meander shape parallel to a flat plane, which has an inner surface coated with a fluorescent powder, and which is provided with a lamp filling comprising a rare gas and mercury and with cold electrodes between which a discharge path extends. The invention further relates to an illumination panel, in particular an illumination panel destined for a liquid crystal display, provided with such a low-pressure mercury discharge lamp.

Such a lamp is known from a brochure of the Harison Electric Co, Ltd. The lamp described therein is recommended for use in an illumination panel for liquid crystal displays. The lamp has an external diameter of 6.2 mm (internal diameter approximately 4.3 mm) and the length of the discharge path is approximately 500 mm. This lamp is bent into a meander shape, i.e. the lamp vessel comprises a number of substantially parallel legs which are connected in series with one another and whose centrelines lie in a flat plane. The known lamp is suitable for being incorporated in an illumination panel for a 6" display screen and results in a smaller constructional height of this panel than is possible with similar bent fluorescent lamps of greater lamp diameter. The operating voltage specified for the known lamp is 530 V and the lamp current is no more than 6.0 mA, which is interesting for the use in portable equipment powered by batteries.

The known lamp is not suitable for larger displays of a similar comparatively small constructional height of the panel. To obtain an even illumination of a greater surface area, one would have to have recourse to a number of lamps of the kind described, so that a number of independent discharge paths would be created. An increase in the number of lamps leads to a proportional increase in the electrode losses, which is a disadvantage in a liquid crystal display unit which is often a portable one provided with a battery system. Moreover, an even illumination of the panel cannot be guaranteed in the case of independently arranged lamps because small differences in brightness between the lamps cannot be avoided in practice.

SUMMARY OF THE INVENTION

The invention has for its object to provide lamps with which illumination panels can be obtained having a very favourable power consumption coupled to a very even surface illumination and a small constructional height.

According to the invention, a low-pressure mercury discharge lamp of the kind mentioned in the opening paragraph is characterized in that the length of the discharge path is at least 250 times and at most 1000 times the internal diameter of the lamp vessel. This geometry involving a comparatively long discharge path in relation to the internal diameter leads to a lamp whose electrode losses are comparatively low, i.e. a greater portion of the power supplied becomes available for the gas discharge. It is also possible now to choose a lamp shape in which the lamp has a comparatively large number of legs situated next to one another, whereby a more unifom light distribution is obtained.

The ratio of the discharge path length to the internal lamp vessel diameter indicated above, which must be at least 250 in order to obtain the envisaged effect, is found to have a maximum value of 1000; it was in fact found that impractically high values for the operating voltage of the lamp are required when this upper limit is exceeded.

In an advantageous embodiment of a low-pressure mercury discharge lamp according to the invention, in which the meander-shaped discharge vessel comprises a number of straight, mutually substantially parallel legs, the internal diameter of the lamp vessel is at least 2.0 and at most 3.5 mm, and is preferably 2.5 mm, and the free distance between the legs is at least equal to and at most 5 times the internal diameter of the lamp vessel. This lamp has the advantage that a very uniform surface illumination and a high luminance are obtained when it is used in an illumination panel. An illumination panel in general comprises a flat box with a bottom and at some distance therefrom and parallel thereto a light-emission surface which is often covered with a diffuser plate. Because of the small internal diameter of the lamp vessel and the limitation of the free distance (the open space) between the legs of the lamp vessel to at most 5 times the internal diameter of the lamp vessel, the light-emission surface is illuminated by a large number of parallel legs, whereby the uniformity of the surface illumination is promoted. A high luminance is obtained in that the distance between the legs is chosen to be at least equal to the internal diameter of the lamp vessel. The open spaces between the legs are then in fact sufficiently great for allowing the light radiated by the lamp in the direction of the bottom to pass for the major part after reflection against the bottom, so that this light can make a contribution to the luminance of the illumination panel.

In this embodiment of a lamp according to the invention, the internal diameter of the lamp vessel is chosen to be not smaller than 2.0 mm in order to prevent that lamp impedance values arise which are too high for practical applications. On the other hand, the internal diameter of the discharge vessel is chosen to be not greater than 3.5 mm in order to render possible small constructional heights of illumination panels provided with such lamps.

It was found that illumination panels can be realised with the chosen lamp geometry with a very uniform surface illumination, a high luminance, and a high efficacy, for example 10 cd/W, while the constructional height of such panels is limited, for example 15 mm or less.

It is further noted that U.S. Pat. No. 4,842,378 discloses a liquid crystal display which is provided with an illumination panel in which a discharge lamp bent into a meander shape is arranged. This lamp, which has an internal diameter of approximately 4.5 mm, is not a low-pressure mercury discharge lamp but a neon discharge lamp which comprises no luminescent materials and which has a substantially lower luminous efficacy than can be achieved with low-pressure mercury discharge lamps.

In general, a contribution in the blue, green, and red portions of the spectrum is necessary for the rendering of colour images. These contributions can be provided by a fluorescent powder which comprises a material activated by bivalent europium, a material activated by trivalent terbium, and a material activated by trivalent europium. A lamp according to the invention is accordingly preferred which is provided with a fluorescent powder which comprises at least a luminescent material from each of the said groups of materials.

The invention also relates to an illumination panel, in particular one destined for a liquid crystal display, which panel comprises a flat box with a bottom and at a certain distance therefrom and parallel thereto a light-emission surface which is covered by a diffuser plate, and is characterized in that the panel is provided with a low-pressure mercury discharge lamp according to the invention arranged between the bottom and the diffusor plate.

BRIEF DESCRIPTION OF THE DRAWINGS

Embodiments of a low-pressure mercury discharge lamp and an illumination panel according to the invention are shown in the drawing, in which.

DETAILED DESCRIPTION OF THE PREFERRED EMBODIMENTS

Figure 1:
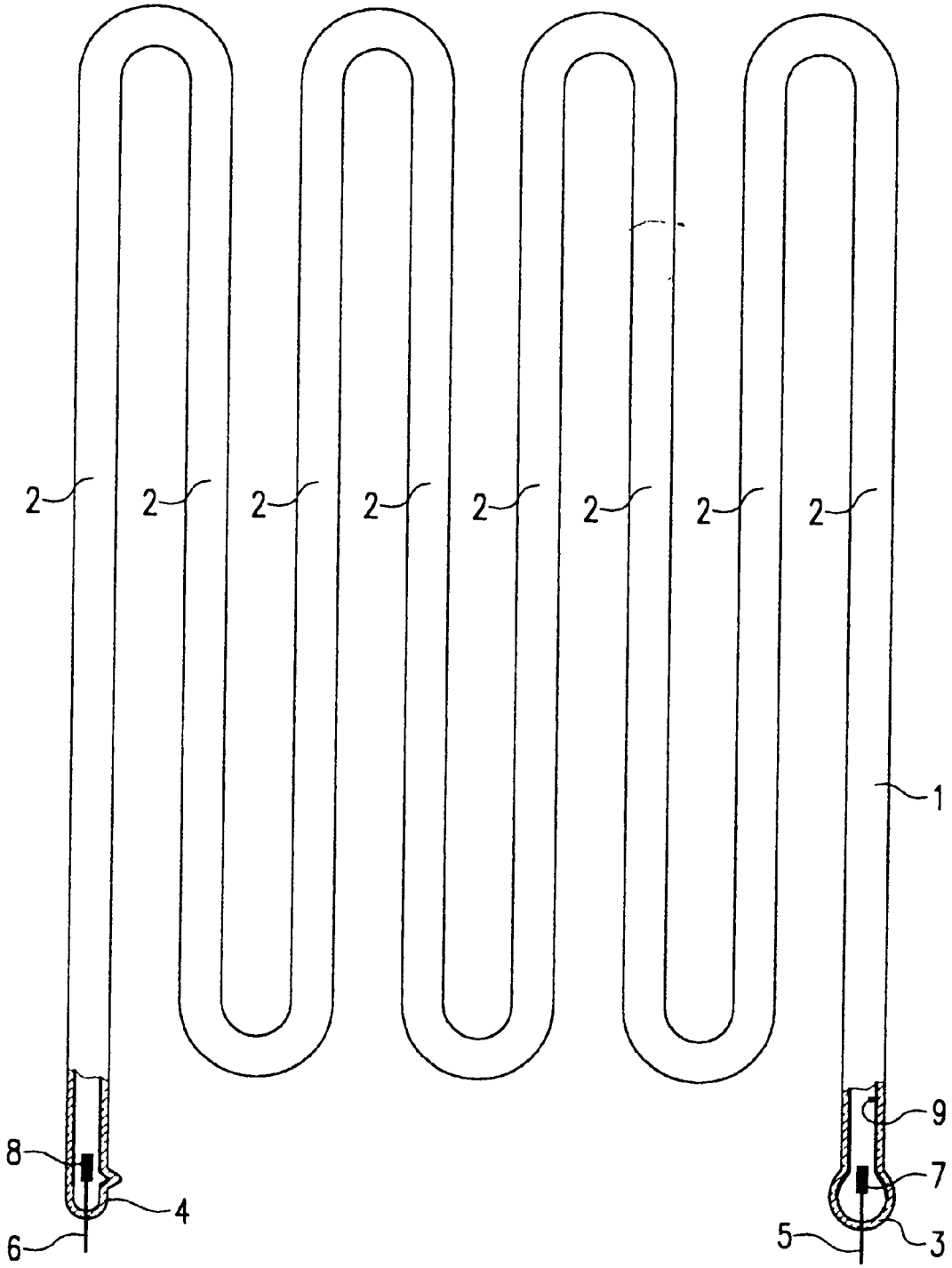
FIG. 1 shows a low-pressure mercury discharge lamp in elevation and partly in cross-section.

The low-pressure mercury discharge lamp of FIG. 1 has a tubular glass lamp vessel 1 which is sealed in a vacuumtight manner and which extends in a meander shape parallel to a plane surface. The lamp vessel 1 has eight straight, substantially parallel legs 2. Current lead-throughs 5, 6, each supporting a cold electrode 7, 8 inside the lamp vessel, are sealed in at the ends 3, 4 of the lamp vessel 1. The lamp vessel 1 has an internal diameter of 2.6 mm, a wall thickness of 0.8 mm, and a length of 93 cm. The length of the discharge path is 90 cm, i.e. 346 times the internal diameter of the lamp vessel 1. The inner surface of the lamp vessel 1 is coated with a luminescent layer 9 comprising a mixture of blue-luminescing barium-magnesium aluminate activated by bivalent europium, green-luminescing cerium-magnesium aluminate activated by trivalent terbium, and red-luminescing yttrium oxide activated by trivalent europium. The mixing ratio of these luminescent materials is so chosen that the lamp radiates white light with a colour temperature of 4000 K during operation. The free distance between the legs 2 of the lamp is 7 mm, i.e. 2.7 times the internal diameter of the lamp vessel 1. Owing to this choice of the ratio of the free distance to the internal diameter (i.e. between the values 1 and 5), a very uniform surface illumination with high luminance is possible when this lamp is used in an illumination panel. The lamp vessel 1 of the lamp is filled with a small quantity of mercury and a mixture of neon and argon to a pressure of 40 mbar. The lamp has a luminous efficacy of approximately 70 lm/W at a power consumption of approximately 3.5 W (amp current 3 mA) and is suitable for use in a 6" display.

Figure 2:
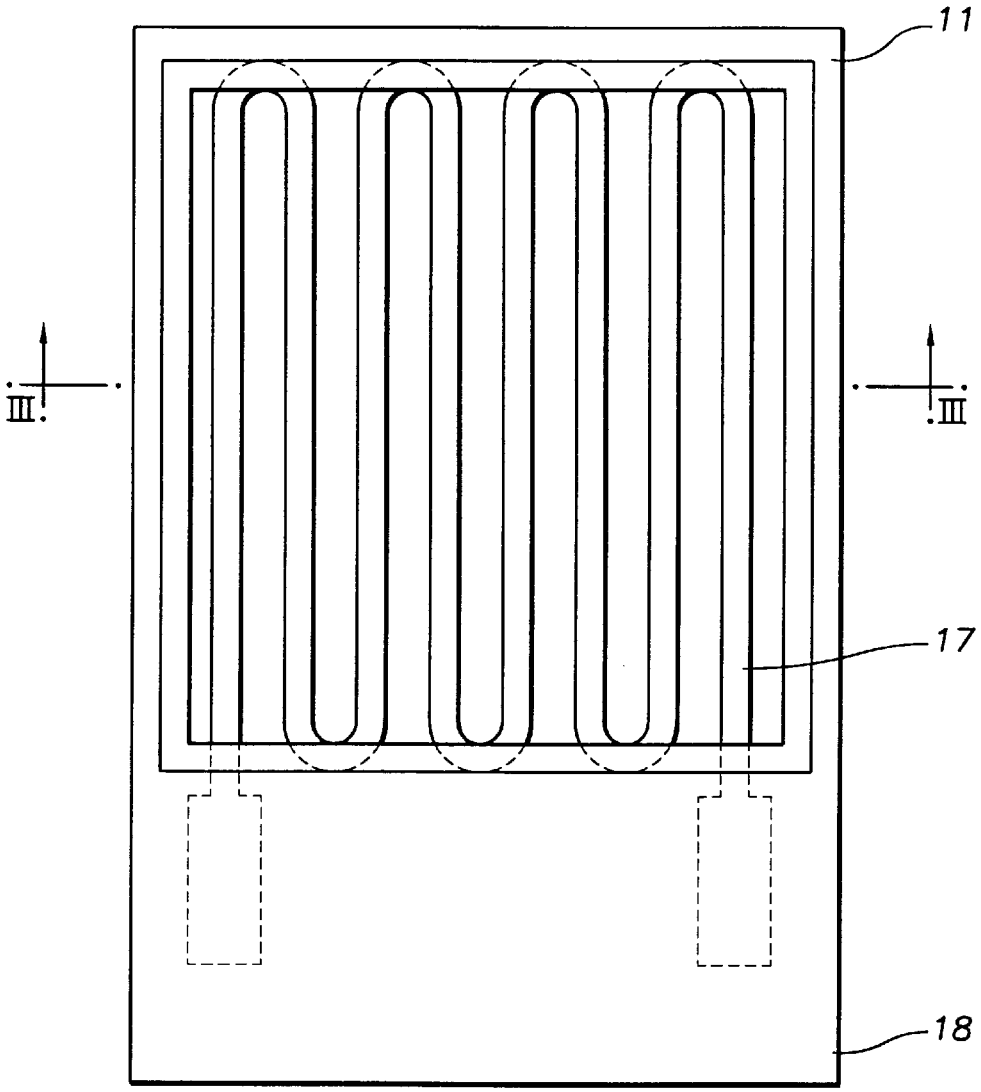
FIG. 2 is a diagrammatic picture of an illumination panel in plan view.
Figure 3:
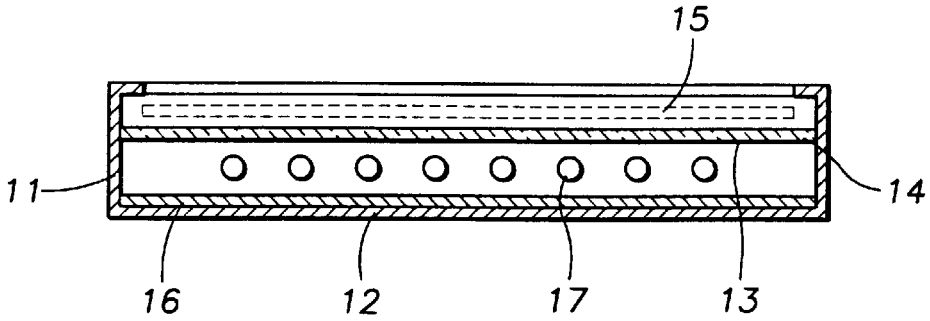
FIG. 3 is a cross-section of the panel of FIG. 2 taken on the line III—III.

The illumination panel diagrammatically depicted in FIGS. 2 and 3 comprises a housing 11 in the form of a flat box with a bottom 12 and a light-emission surface 13 extending parallel to said bottom and covered by a diffuser plate 14. A liquid crystal display 15 arranged on the diffusor plate 14 is indicated by broken lines. The bottom 12 of the housing 11 is provided with a reflector layer 16. A lamp 17 of the kind described with reference to FIG. 1 is arranged in the housing 11. A battery-powered supply source (not shown) for the lamp 17 is accommodated in a portion 18 of the housing 11. This supply source delivers an operating voltage of 1200 V (25 kHz). The illumination panel is suitable for a 6" display and supplies an efficacy of 10 candelas per watt during operation.

We claim:

1. A low-pressure mercury discharge lamp comprising an elongate tubular lamp vessel which is sealed in a vacuumtight manner, extends in a meander shape parallel to a flat plane, has an inner surface coated with a luminescent layer, and includes a lamp filling comprising a rare gas and mercury, and cold electrodes between which a discharge path extends, characterized in that:

the length of the discharge path is at least 250 times and at most 1000 times the internal diameter of the lamp vessel.

2. A low-pressure mercury discharge lamp as claimed in claim 1, in which the meander-shaped discharge vessel comprises a number of straight, mutually substantially parallel legs, characterized in that the internal diameter of the lamp vessel is at least 2.0 and at most 3.5 mm, and the free distance between the legs is at least equal to and at most 5 times the internal diameter of the lamp vessel.

3. A low-pressure mercury discharge lamp as claimed in claim 2, characterized in that the luminescent layer comprises a luminescent material activated by bivalent europium, a luminescent material activated by trivalent terbium, and a luminescent material activated by trivalent europium.

4. A low-pressure mercury discharge lamp as claimed in claim 1, characterized in that the luminescent layer comprises a luminescent material activated by bivalent europium, a luminescent material activated by trivalent terbium, and a luminescent material activated by trivalent europium.

5. A low pressure mercury discharge lamp as claimed in claim 2, wherein the internal diameter of said lamp vessel is about 2.5 mm.

6. An illumination panel for a liquid crystal display, comprising:

a first main surface;

a light diffuser plate spaced from and extending generally parallel to said first main surface; and a low pressure mercury vapor discharge meander lamp between said first main surface and said light diffuser plate, said lamp comprising an elongate tubular lamp vessel which is sealed in a vacuumtight manner, extends in a meander shape parallel to a flat plane, has an inner surface coated with a luminescent layer, and includes a lamp filing comprising a rare gas and mercury, and cold electrodes between which a discharge path extends, the length of the discharge path being at least 250 times and at most 1000 times the internal diameter of the lamp vessel.

7. An illumination panel according to claim 6, in which the meander-shaped discharge vessel comprises a number of straight, mutually substantially parallel legs, and the internal diameter of the lamp vessel is at least 2.0 and at most 3.5 mm, and the free distance between the legs is at least equal to and at most 5 times the internal diameter of the lamp vessel.

8. An illumination panel according to claim 7, characterized in that the luminescent layer comprises a luminescent material activated by bivalent europium, a luminescent material activated by trivalent terbium, and a luminescent material activated by trivalent europium.

9. An illumination panel as claimed in claim 7, wherein the internal diameter of said lamp vessel is about 2.5 mm.

10. An illumination panel according to claim 6, characterized in that the luminescent layer comprises a luminescent material activated by bivalent europium, a luminescent material activated by trivalent terbium, and a luminescent material activated by trivalent europium.

* * * * *